US006081604A

United States Patent [19]

Hikichi et al.

[11] Patent Number: 6,081,604

[45] Date of Patent: Jun. 27, 2000

[54] ELECTRIC SOUND CONVERTER

[75] Inventors: Hideto Hikichi; Mitsuo Miyata, both of Yokohama; Hiroyuki Suzuki, Machida, all of Japan

[73] Assignee: Kabushiki Kaisha Audio-Technica

[21] Appl. No.: 09/040,812

[22] Filed: Mar. 18, 1998

[30] Foreign Application Priority Data

Mar. 19, 1997 [JP] Japan ..... 9-085732

[51] Int. Cl.[7] ..... H04R 25/00

[52] U.S. Cl. ..... 381/371; 381/124; 381/172; 381/355; 381/367; 381/370; 381/378; 381/426

[58] Field of Search ..... 381/124, 170, 381/172, 355, 360, 361, 367, 369, 370, 371, 375, 376, 426, 429

[56] References Cited

U.S. PATENT DOCUMENTS 2,846,521 8/1958 Beidler ..... 381/375

5,381,486 1/1995 Ludeke et al. ..... 381/187

5,706,359 1/1998 Chang ..... 381/169

FOREIGN PATENT DOCUMENTS 7000630A 1/1995 Japan ..... A63F 9/10

9286171A 11/1997 Japan ..... B41M 5/26

*Primary Examiner*—Curtis A. Kuntz

*Assistant Examiner*—Suhan Ni

*Attorney, Agent, or Firm*—Welsh & Katz, Ltd.

[57] ABSTRACT

A head-phone having a case member storing therein a headphone unit, wherein a coating film containing a light discolor pigment to be discolored by irradiation of sun light is provided on the whole surface or a predetermined surface of the case member.

21 Claims, 3 Drawing Sheets

ELECTRIC SOUND CONVERTER

FIELD OF THE INVENTION

The present invention relates to an electric sound converter for a head-phone, a micro-phone and the like. More specifically, the present invention relates to an electric sound converter rich in visual idea or design in which a case member is discolored by irradiating sun light.

PRIOR ART

A conventional electric sound converter such as a head-phone, a micro-phone or the like will be described taking a head-phone as an example. The head-phone can be roughly divided into an ear pad system for covering the whole ear portion so as to surround the outside of an ear ring, and an inner ear system used while being inserted into an external ear.

The head-phone of the ear pad system is provided with a head band which is formed into an approximately U-shape mounted on a head top portion of a user, and a case member (a head-phone case) encasing a head-phone therein, having a shape to cover an ear portion of a user. This case member is held adjustably in angle and rotatably on the end of the head band through a hanger member in the form of a universal joint. Lately, there is commercially available one in which a case member itself can be stopped directly at an ear ring of a user, and a head band is not necessary.

In the case of the ear pad system head-phone, a fundamental form of the case member is a hemispherical shape or a half-egg shape, which is very noticeable in terms of shape and size of the head-phone.

Despite the fact as described, in the past, importance has been attached to only the functional aspect such as sound quality, and no consideration has been taken into a design, particularly, color. Accordingly, the case member of the conventional ear pad system head-phone is generally black, lacking a visual interest.

Further, with respect to the micro-phone, there were similar drawbacks. That is, the micro-phone is fundamentally interiorly provided with a grip portion in which a micro-phone unit is received, and a window screen mounted on the end of the grip portion. However, also in the micro-phone as described above, its shape is naturally limited in terms of function, and not much peculiarity is provided in terms of design.

SUMMARY OF THE INVENTION

An object of the present invention is to provide an electric sound converter such as a head-phone, a micro-phone or the like rich in visual design in which color of a case member is changed.

The electric sound converter according to the present invention is composed of a case member encasing an electric sound conversion unit therein, and a discolor portion in which either the whole surface or a predetermined surface of the case member is applied with treatment so as to be discolored by irradiation of sun light.

The discolor portion preferably comprises a coating film formed of a transparent coating containing a light discoloring pigment and the coating film is formed on a portion of the case member to be discolored. This coating film is discolored into orange or blue, for example, according to the light discoloring pigment contained by being exposed to sun light. Even in the cloudy weather, discolor occurs though inferior to that of fine weather.

This case member can be formed of opaque synthetic resin or metal, but preferably of see-through synthetic resin in which the ground color of the case member is white, in order to further clarify the discolor effect. It is to be noted that use can be made of a synthetic resin in which the case member is colorless and transparent. In this case, however, a frosting agent as well as a light discolor pigment are added to the transparent boating to thereby enhance the discolor effect.

Further, the discolor portion can be also formed from a laminated coating film of at least two kinds of transparent coating containing a different light discolor pigment. That is, a coating film discolored into blue, for example, is formed on the whole surface of the case member, after which a coating film discolored into yellow is finish-coated on the lower half of the case member whereby when exposed to sun light, the upper half will be blue , and the lower half will be green.

Further, in the case where the case member is formed of transparent or white see-through synthetic resin, the light discolor pigment is mixed into the synthetic resin and the case member is molded by injection molding, for example, to provide the discolor effect similar to the coating film as described above.

Preferably, the present invention is applied particularly to the ear pad system head-phone and micro-phone. That is, in case of the ear pad system head-phone, it has a shape to cover an ear portion of a user, and is provided with a head-phone case encasing therein a head-phone unit as an electric sound unit, and a discolor portion applied with discolor treatment is provided on the head-phone case to thereby obtain a unique design effect that is not present in the past.

Further, in the case of the micro-phone, discolor portions are respectively provided on a grip portion-encasing therein a microphone unit as an electric sound conversion unit and a window screen mounted on an end of the grip portion to thereby obtain a unique design effect that is not present in the past, similar to the case of the head-phone.

DESCRIPTION OF THE PREFERRED EMBODIMENTS

A first embodiment to which the present invention is applied to a head-phone will be described hereinafter with reference to the drawings.

Figure 1:
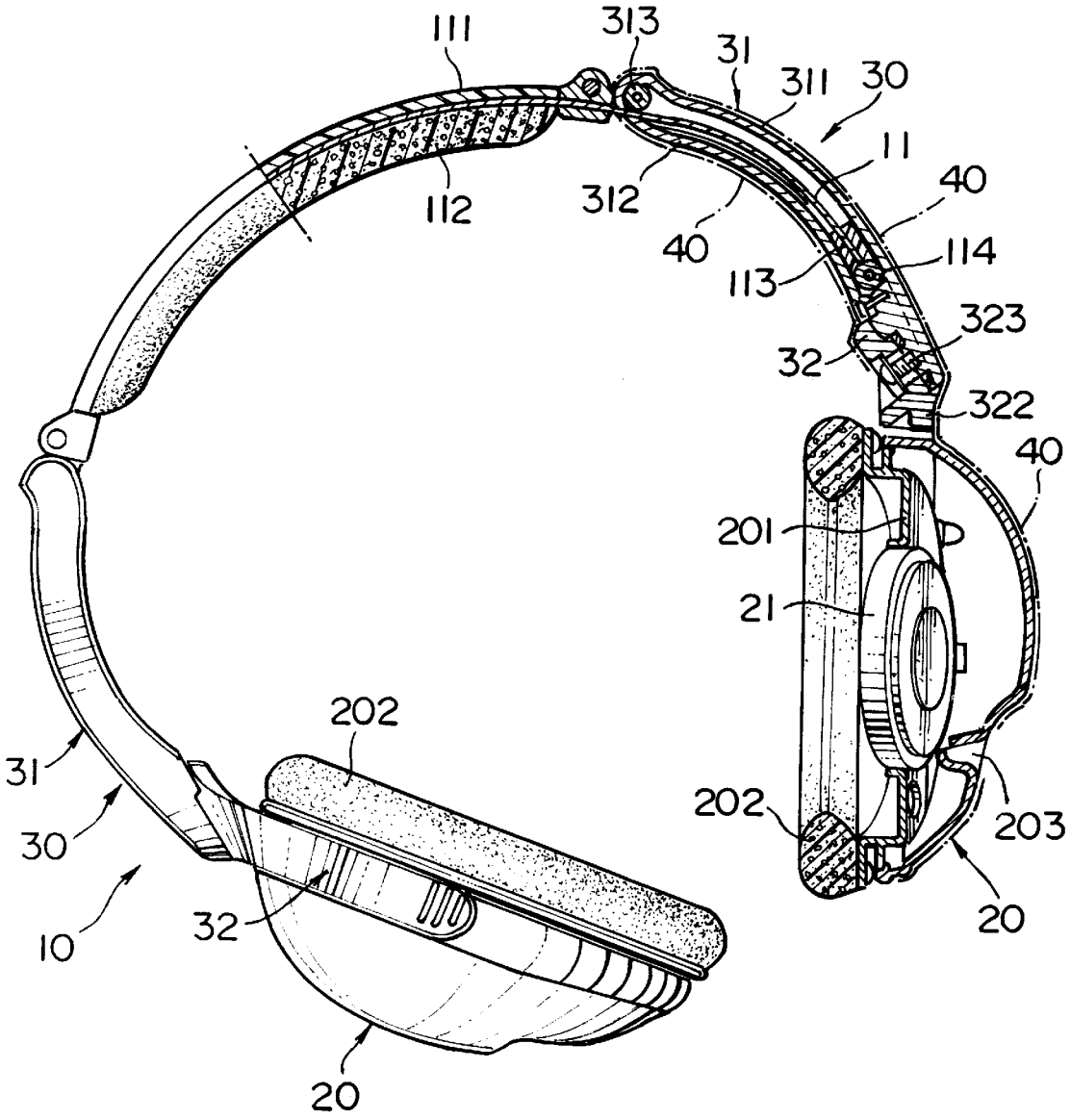
FIG. 1 is a front view showing, in section, a left half of a headphone according to a first embodiment of the present invention.
Figure 2:
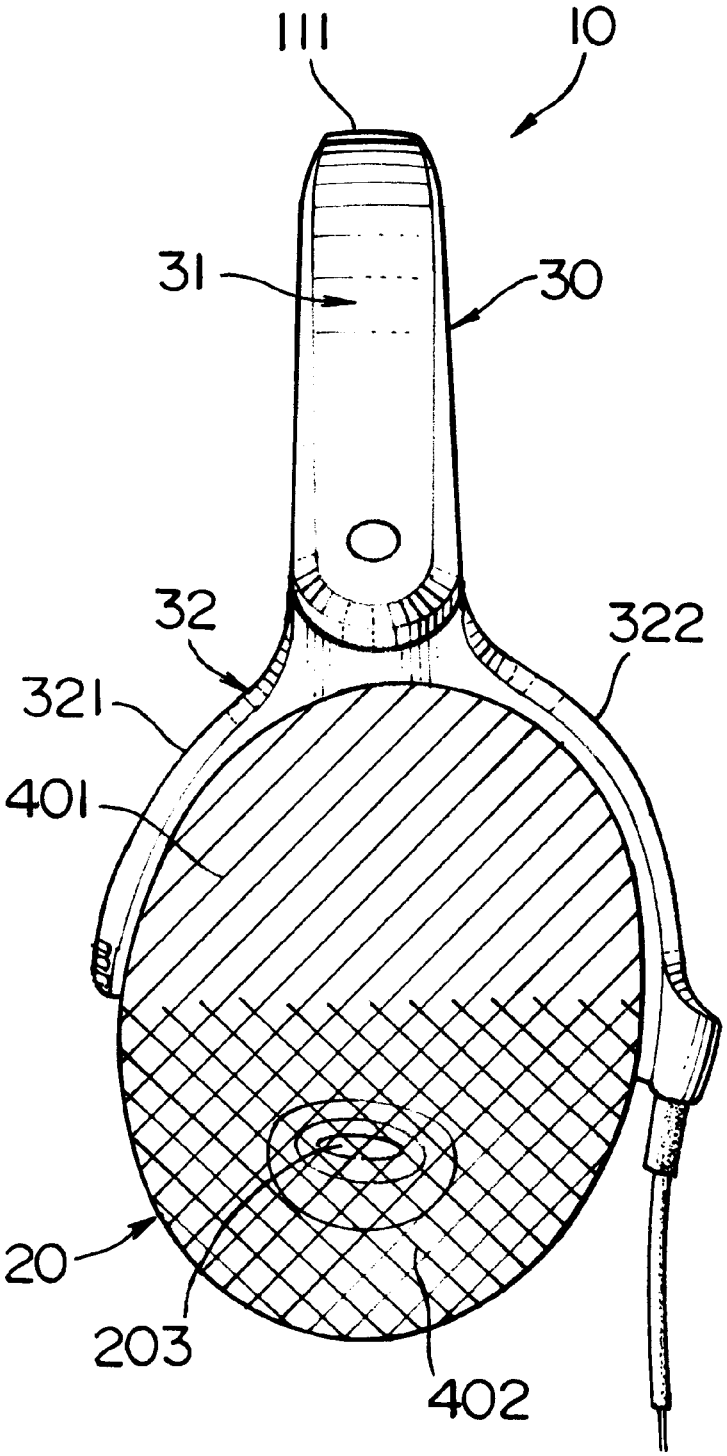
FIG. 2 is a left side view of the head-phone according to the first embodiment of the present invention.

Referring to FIGS. 1 and 2, a head-phone 10 is provided with a head band 11 which is formed into an approximately U-shape so that both ends thereof are positioned at side head portions of ears of a user. A band cover 111 having a head pad 112 is mounted on a portion in contact with a head top portion of the head band 11.

Case members (head-phone cases) 20, 20 each encasing a head-phone unit 21 therein are held symmetrically to left and right on both ends of the head band 11. The case members 20, 20 are held on both ends of the head band 11 through adjust members 30, 30. Since the case members 20, 20 and the adjust members 30, 30 are same in construction, the case member 20 and the adjust member 30 on the left side in which their section is shown will be described.

The adjust member 30 is provided with a flat elongated tubular member 31 for slidably receiving an end of the head band 11 therein. The tubular member 31 comprises a combination of an upper holder cover 311 and a lower holder cover 312, and on the upper end interiorly thereof is provided a roller 313 for smoothly sliding the end of the head band 11.

On the other hand, the head band 11 is provided in its end with a stopper 113 mating with the roller 313, and a guide roller 114 which is rolled within the adjust member 30 to smoothly slide the end of the head band 11 similarly to the guide roller 313.

At the lower part of the adjust member 30, a hanger 32 for holding the case member 20 is rotatably provided through a screw 323 with a washer. This rotation is in a direction perpendicular to a paper surface in FIG. 1 (a lateral direction in FIG. 2). The hanger 32 has forked arm members 321, 322, between both ends of which is held the case member 20 adjustably in angle with respect to the ears of the user.

The case member 20 is formed, for example, in the shape of a half egg having a size placed externally of an ear ring of the user, and is internally provided with a dough-nut like support frame 201. The head-phone unit 21 is fitted and held in a central opening of the support frame 201. An ear pad 201 is provided on the open peripheral edge of the case member 20, and the case member 20 is bored with a a sound release hole 203 for controlling a low sound amount of the head-phone unit 21.

In the first embodiment, both the case member 20 and the adjust member 30 are formed of a white transparent synthetic resin, and a coating film formed of a transparent coating containing a light discoloring pigment is provided on the surface thereof. This coating film is so thin that is difficult to show in the figure, but in FIG. 1, it is conveniently shown by one dot contour line at 40.

The light discoloring pigment used herein is discolored when being exposed to sun light, and includes a photochromic dye, for example. This pigment is colorless but is discolored into red when exposed to the sun light.

Since the coating film 40 is colorless in the case where it is not opposed to sun light or minutely opposed (for example, when used in a room at night), the head-phone unit 21 within the case member 20 and a slide mechanism within the adjust member 20 can be seen through, and a mechanical design thereof can be enjoyed. On the other hand, in the case where the coating film 40 is exposed to sun light in the daytime, it is discolored into red or blue, for example, and therefore its design can be enjoyed double.

Further, in the case where a colored coating containing a light discoloring pigment is provided on the surface of a white transparent resin, when for example, the blue coating film 40 is exposed to sun light, the film can be discolored from one color to another, such that it is discolored into green.

The coating film 40 can be formed on suitable places of the case member 20 and the adjust member 30 by printing or spray-coating. Note that the surface to be coated needs not always be transparent but can be a metal surface, for example, and accordingly, it can be also applied to the head band 11.

As shown by the diagonal line in FIG. 2, a coating film 401 to be discolored into blue, for example, is formed on the whole surface of the case member 20, after which as shown by the cross hatching in FIG. 2, a coating film 402 to be discolored into yellow is finish-coated on the lower half of the case member 20 whereby when exposed to sun light, the upper half can be blue and the lower half can be green. In this manner, it is possible to synthesize various colors to provide coloring as desired.

In the first embodiment, the coating film 40 containing the light discolor pigment is provided on the surface of the case member 20 or the like. However, this is not a limitation, but for example, in the case where the case member 20 is molded by injection molding of a transparent synthetic resin, even if a light discolor pigment is mixed into the transparent synthetic resin in advance, the light discolor effect can be obtained similar to the previous embodiment.

Further, while in the head-phone according to the first embodiment, the head band 11 is used to apply the case member 20 to the ear portion of a-user, it is noted that the present invention can be also applied to a head-phone of an ear type which uses no head band, a head-phone of a head set type, and a head-phone of an inner ear type, etc.

Figure 3:
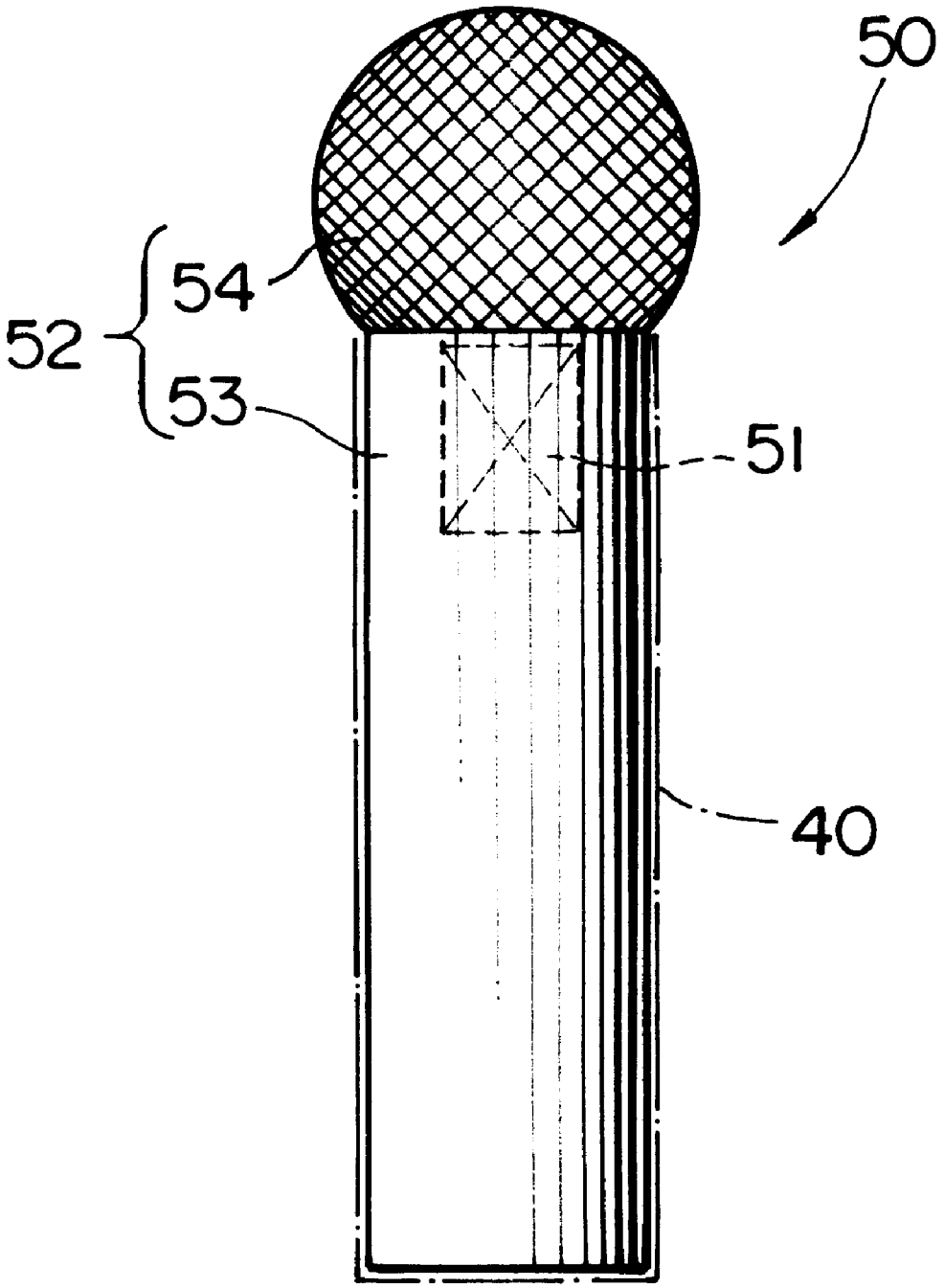
FIG. 3 is a front view showing a micro-phone according to a second embodiment of the present invention.

Next, a second embodiment, in which the present invention is applied to a hand type microphone, will be described with reference to FIG. 3. A hand type microphone 50 is provided with a microphone case 52 comprising a cylindrical grip portion 53 encasing a microphone unit 51 therein and a window screen 54 mounted on an end on the sound collecting side of the grip portion 53, similar to the conventional hand type microphone.

According to the second embodiment, the coating film 40 formed of a transparent coating containing a light discolor pigment described in the first embodiment described above is provided on the microphone case 52. However, there are various patterns of forming a coating film, such that the coating film 40 is provided merely on the grip portion. For example, one and the same coating film 40 may be formed over the entire surface of the grip portion 53 and the window screen 54, or transparent coatings containing different light discolor pigments may be separately coated on the grip portion 53 and the window screen 54 to discolor them in different colors.

Further, two or more transparent coatings containing different light discolor pigments are coated one upon another to synthesize colors to provide coloring as desired. Further, the grip portion 53 is normally made of metal such as aluminum, but in the case where the grip portion 53 is molded by injection molding of transparent synthetic resin, even if the light discolor pigment is mixed into the transparent synthetic resin, similar light discolor effect can be obtained.

While capable of being applied to any of the above-described embodiments, for example, trademarks, product names or character figures can be depicted on the surface of the case member to thereby obtain a distinctive effect.

While in the embodiments of the present invention, the coating film containing the light discolor pigment is provided on the head-phone and the case member of the microphone, it is noted that even if it is applied to the cords of the head-phone or the microphone, the light discolor effect similar to the above-described embodiments.

What is claimed is:

1. An electrical acoustic transducer including an electrical acoustic unit and a case member for housing said electrical acoustic unit, said electrical acoustic transducer further including said case member made of a synthetic resin, the synthetic resin being substantially transparent, said case having at least one or more treated surface areas, each of the treated surface areas being coated with a first transparent paint, said transparent paint containing light-discoloring pigment, whereby said treated surface areas of the case member are opaque in light, and transparent in the dark.

2. The electrical transducer of claim 1, wherein said acoustic electrical transducer unit is a head phone unit, and said case member comprises a head phone case, the case member being formed such that the ears of a user are covered therewith.

3. The electrical transducer of claim 1, wherein said transducer unit, and said case member comprise a microphone unit, and a microphone case respectively, the microphone case having a grip portion, the microphone unit being accommodated in the grip portion, and a window screen for covering the microphone unit is mounted on an end surface of the grip portion of the microphone case.

4. The electrical acoustic transducer of claim 1, wherein at least one of said treated areas of the case member is partially coated with a second transparent paint different from the first transparent paint.

5. The electrical acoustic transducer of claim 4, wherein said acoustic electrical transducer unit is a head phone unit, and said case member comprises a head phone case, the case member being formed such that the ears of a user are covered therewith.

6. The electrical acoustic transducer of claim 4, wherein said transducer unit, and said case member comprise a microphone unit, and a microphone case, respectively, the microphone case having a grip portion, the microphone unit being accommodated in the grip portion, and a window screen for covering the microphone unit is mounted on an end surface of the grip portion of the microphone case.

7. An electrical acoustic transducer including an electrical acoustic unit and a case member for covering said electrical acoustic unit; said case member being transparent and having at least one treated surface area, each of the treated surface areas being coated with a transparent paint, said transparent paint containing a light-discoloring pigment, whereby said treated surface areas of the case member become opaque under light, and remain transparent in the dark.

8. The electrical acoustic transducer of claim 7, wherein said acoustic electrical transducer unit is a head phone unit, and said case member comprises a head phone case, the case member being formed such that the ears of a user are covered therewith.

9. The electrical acoustic transducer of claim 7, wherein said transducer unit, and said case member comprise a microphone unit, and a microphone case, respectively, the microphone case having a grip portion, the microphone unit being accommodated in the grip portion, and a window screen for covering the microphone unit is mounted on an end surface of the grip portion of the microphone case.

10. The electrical acoustic transducer of claim 7, wherein at least one of said treated surface areas of the case member is partially coated with a second transparent paint different from the first transparent paint.

11. The electrical acoustic transducer of claim 10, wherein said acoustic electrical transducer unit is a head phone unit, and said case member comprises a head phone case, the case member being formed such that the ears of a user are covered.

12. The electrical acoustic transducer of claim 10, wherein said transducer unit, and said case member comprise a microphone unit, and a microphone case, respectively, the microphone case having a grip portion, the microphone unit being accommodated in the grip portion, and a window screen for covering the microphone unit is mounted on an end surface of the grip portion of the microphone case.

13. An electrical acoustic transducer including an electrical acoustic unit; and a case member for covering said electrical acoustic unit, said electrical acoustic transducer further including said case member being transparent and including a light discoloring pigment mixed therein, whereby said case member is opaque under light, and transparent in the dark.

14. The electrical acoustic transducer of claim 13, wherein said acoustic electrical transducer unit is a head phone unit, and said case member comprises a head phone case, the case member being formed such that the ears of a user are covered therewith.

15. The electrical acoustic transducer of claim 13, wherein said transducer unit and said case member comprise a microphone unit, and a microphone case, respectively, the microphone case having a grip portion, the microphone unit being accommodated in the grip portion, and a window screen for covering the microphone unit is mounted on an end surface of the grip portion of the microphone case.

16. An electrical acoustic transducer including an electrical acoustic unit; and a case member for covering said electrical acoustic unit, said electrical acoustic transducer further including said case member made of an opaque synthetic resin or a metal material, said case having at least one or more treated surface areas, each of the treated surface areas being coated with a transparent paint, said transparent paint containing a light-discoloring pigment, whereby said treated surface areas of the case member are opaque under light, and transparent in the dark.

17. The electrical acoustic transducer of claim 16, wherein said acoustic electrical transducer unit is a head phone unit, and sad case member comprises a head phone case, the case member being formed such that the ears of a user are covered therewith.

18. The electrical acoustic transducer of claim 16, wherein said transducer unit, and said case member comprise a microphone unit, and a microphone case, respectively, the microphone case having a grip portion, said microphone unit being accommodated in the grip portion, and a window screen for covering the microphone unit is mounted on an end surface of the grip portion of the microphone case.

19. The electrical acoustic transducer of claim 16, wherein at least one of said treated areas of the case member is partially coated with a second transparent paint different from the first transparent paint.

20. The electrical acoustic transducer of claim 19, wherein said acoustic electrical transducer unit is a head phone unit, and said case member comprises a head phone case, the case member begin formed such that the ears of a user are covered therewith.

21. The electrical acoustic transducer of claim 19, wherein said transducer unit, and said case member comprise a microphone unit, and a microphone case, respectively, the microphone case having a grip portion, the microphone unit being accommodated in the grip portion, and a window screen for covering the microphone unit is mounted on an end surface of the grip portion of the microphone case.

* * * * *